United States Patent [19]

Irvin

[11] 4,302,866

[45] Dec. 1, 1981

[54] RELEASABLE HINGE FOR SWINGABLE PORTIONS OF A CONTAINER

[75] Inventor: Ronald D. Irvin, Poway, Calif.

[73] Assignee: The Quaker Oats Company, Chicago, Ill.

[21] Appl. No.: 113,204

[22] Filed: Jan. 18, 1980

[51] Int. Cl.[3] ..... E05D 1/06; E05D 7/10

[52] U.S. Cl. ..... 16/171; 16/DIG. 13; 220/337; 220/341

[58] Field of Search ..... 16/171, DIG. 13, 128 B; 220/341, 337, 334

[56] References Cited

U.S. PATENT DOCUMENTS

| | | | |
|---|---|---|---|
| 2,960,254 | 11/1960 | Kiba | 16/DIG. 13 |
| 3,432,882 | 3/1969 | Farouche | 16/171 |
| 3,497,908 | 3/1970 | Zamarra | 16/171 |
| 3,952,369 | 4/1976 | Erickson | 16/171 |

FOREIGN PATENT DOCUMENTS

| | | | |
|---|---|---|---|
| 258507 | 11/1967 | Austria | 16/171 |
| 1532860 | 3/1970 | Fed. Rep. of Germany | 220/337 |

*Primary Examiner*—James Kee Chi

*Attorney, Agent, or Firm*—Cumpston & Shaw

[57] ABSTRACT

The object of this invention is to provide a releasable hinge for swingable portions such as a cover and bottom of a container or the like.

The releasable hinge comprises a pair of spaced apart, laterally flexible spring fingers projecting from one wall of one portion of the container into a blind notch on an opposed wall of another portion of the container. The side surfaces of the notch are arranged and spaced to flex the fingers together until lateral porjections at the ends thereof nest into complimentary recesses in the side surfaces for hingedly coupling the container portions together. When the container portions are rotated about the projections to a maximum open position of the container, back surfaces on the fingers engage and pivot about the blind end of the notch. Further open movement of the container portions causes the projections to be forced out of the recesses for releasing the hinge and preventing damage to the hinge and/or container portions.

4 Claims, 7 Drawing Figures

RELEASABLE HINGE FOR SWINGABLE PORTIONS OF A CONTAINER

BACKGROUND OF THE INVENTION

1. Field of the Invention

This invention relates to hinges, and particularly to a releasable hinge for swingable portions such as a cover and bottom of a container or the like.

It is desirable in containers of the type having hinged cover and bottom portions to provide one or more releasable hinges. The releasable hinge prevents damage to the hinge and/or cover and bottom container portions in the event the portions are opened beyond the maximum open position, thereby subjecting the hinge and/or portions to undue stress.

2. Description of the Prior Art

Containers of the type having permanently hinged cover and bottom portions are well known in the art. A problem that arises in the use of such hinged containers, particularly for housing toys or the like, is that the rigidly held hinge and/or container portions may be subjected to undue stress resulting in damage to the hinge and/or container portions. This is particularly likely where the containers are handled by children.

SUMMARY OF THE INVENTION

In accordance with the present invention, a releasable hinge is provided for swingable portions such as a cover and bottom of a container or the like. The cover and bottom portions have rear walls lying substantially in one plane when the container is closed. The rear walls have edge surfaces facing one another in the closed position. One of the rear walls has a pair of spaced apart, laterally flexible spring fingers lying substantially in a plane transverse to the one plane and projecting toward the other rear wall. The free end of each finger extends beyond its complementary edge surface and has a flat front surface and a back surface merging with the front surface at the free end of the finger. Each finger further has a laterally extending rounded projection on the outer side of the free end. A blind notch on the other rear wall receives the fingers, and has side surfaces arranged and spaced to laterally flex the fingers together as they are introduced into the notch. Opposed recesses in the side surfaces at the blind end of the notch receive the projections for hingedly coupling the rear walls together. When the container cover and bottom portions are opened about the hinge past a maximum open position, the back surfaces of the fingers engage and pivot about the blind end of the notch forcing the projections out of the recesses for unhinging the container portions.

In other aspects of the invention, the back surface is transverse to the one plane and extends beyond the rear side of one of the rear walls. The front surface is positioned along the front side of one of the rear walls and lies in a plane parallel to the one plane.

The aforementioned problem of possible damage to hinge and/or cover and bottom portions of a permanently hinged container is solved by the releasable hinge of this invention. The advantage of the releasable hinge is that it allows separation of the cover and bottom portions before damage can occur to the hinge and/or cover and bottom portions.

The invention and its advantages will become more apparent from the detailed description of the invention presented below.

BRIEF DESCRIPTION OF THE DRAWING

The details of this invention will be described in connection with the accompanying drawing, in which.

DETAILED DESCRIPTION OF THE INVENTION

Figure 1:
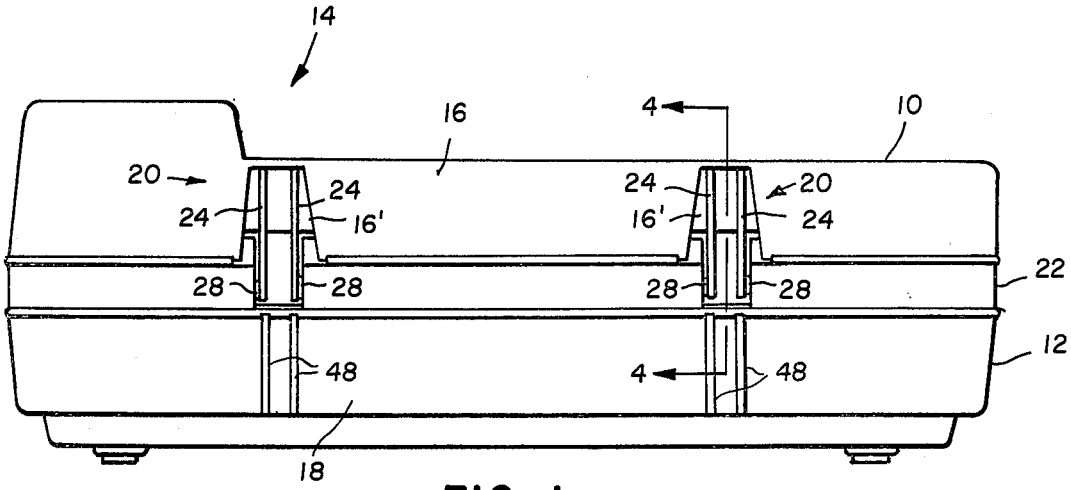
FIG. 1 is a rear elevational view of a container in which a preferred embodiment of the releasable hinge of this invention is incorporated.
Figure 4:
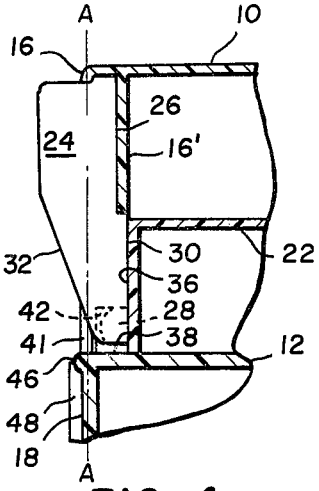
FIG. 4 is a section view of the assembled hinge taken substantially along line 4—4 of FIG. 1.

Referring to FIG. 1 of the drawing, cover and bottom portions 10, 12 respectively of a container 14 are shown having cover and bottom rear walls 16, 18 respectively hinged together by a pair of releasable hinges 20. The rear walls 16, 18 lie substantially in a plane A—A when the container is closed as best seen in FIG. 4. The bottom portion 12 includes a platform 22 secured thereto for supporting any suitable item(s), not shown. The portions 10, 12 and platform 22 are preferably molded from any suitable polymeric material. The hinges 20 are designed such that opening of the container 14 beyond a maximum open position automatically causes the hinges to be released so that no damage will occur to hinge 20 and/or cover and bottom portions 16, 18 respectively of the container. This might otherwise occur, particularly if the container 14 is roughly handled by children or the like.

Figure 2:
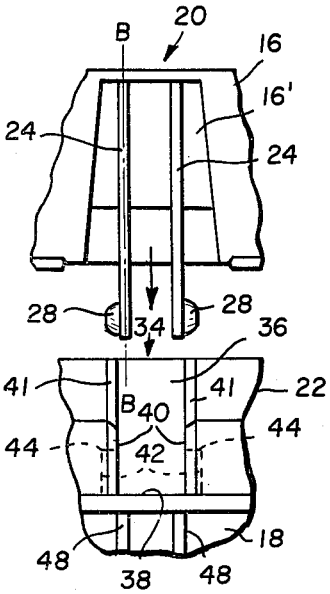
FIG. 2 is a segmental view of one of the hinges of FIG. 1 with cover and bottom hinge parts thereof shown separated and in an aligned position to be joined.

With reference to FIG. 2, one of the hinges 20 is shown comprising a cover hinge part spaced above and in alignment with a bottom hinge part. The cover hinge part comprises a pair of spaced apart untensioned flexible spring fingers 24 in which the upper front end 26 of each finger is integral with a recessed rear wall section 16' of cover portion 16 as best seen in FIG. 4. The lower free end of each finger 24 projects from rear wall section 16' and has a projection 28 on the outside surface thereof having an arcuate surface terminating in a flat edge 29. Each finger further has a lower flat front surface 30, and a back surface 32 transverse to plane A—A as best seen in FIG. 4. Flat edge 29 and front surface 30 lie in the same plane. Each finger also lies in a plane B—B (FIG. 2) which is perpendicular to plane A—A.

The lower hinge part comprises a blind notch 34 in bottom container portion 18 having a flat front surface 36, a blind end surface 38 and side surfaces 40 provided with recesses 42 adjacent the blind end surface for receiving projections 28. Side surfaces 40 have beveled edges 41 to facilitate insertion of fingers 24 and projections 28 into notch 34.

Figure 3:
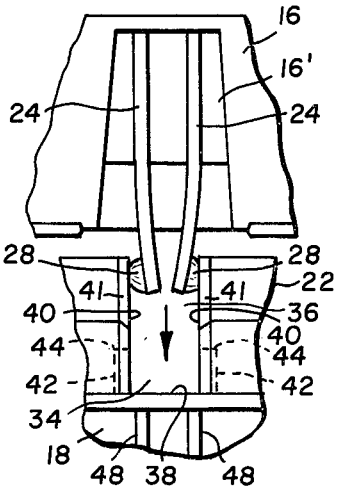
FIG. 3 is a segmental view similar to FIG. 2 showing the cover and bottom hinge parts partly assembled.

With reference to FIG. 3, the cover and bottom hinge parts are shown in the process of being hingedly coupled together. The distance between side surfaces 40 of notch 34 is less than the distance between the outermost surfaces of the projections 28. Accordingly, forcing fingers 24 in the direction of the arrows in FIGS. 2 and 3 into notch 34 with front flat finger surfaces 30 in sliding engagement with front notch surfaces 36 (FIG. 4) causes spring fingers 24 to flex laterally inwardly toward one another into a tensioned condition as best seen in FIG. 3.

With reference to FIGS. 1 and 4, the fingers 24 have been forced all the way into notch 34 causing projections 28 to align with and enter recesses 42 as the fingers automatically spring back to their untensioned condition. This automatically hingedly couples the cover and bottom container portions 10, 12 together. Such coupling can also be achieved in other ways, for example, by aligning projections 28 with recesses 42 while holding cover 10 with fingers 24 substantially at right angles to notch 34, and then pushing projections 28 past beveled edges 41 into recesses 42.

Figure 5:
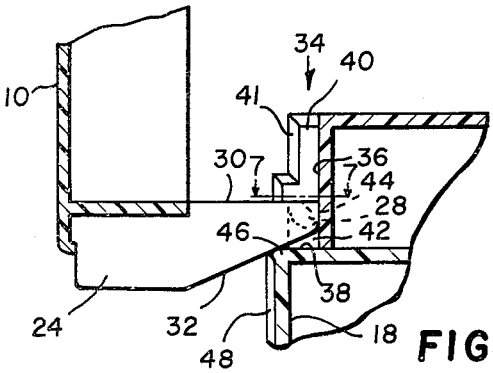
FIG. 5 is a segmental view of the hinge showing the position of the cover and bottom hinge parts when the cover and bottom container portions are opened to a maximum open position.
Figure 6:
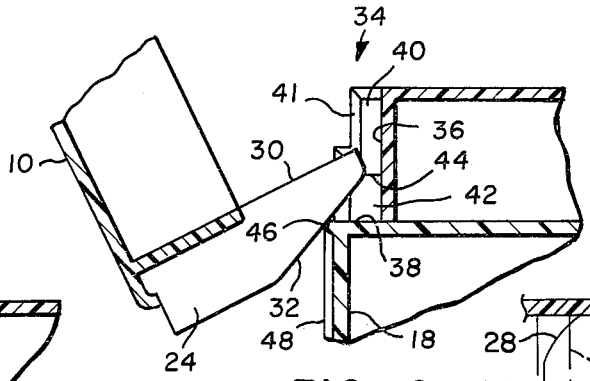
FIG. 6 is a segmental view similar to FIG. 5 showing the container portions opened beyond the maximum open position, and the hinge about to be released.
Figure 7:
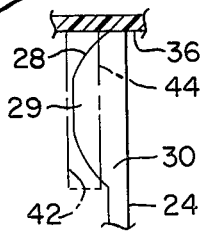
FIG. 7 is an enlarged segmental view taken along line 7—7 of FIG. 5 with the end wall of a recess shown in phantom.

With reference to FIG. 5, the cover portion 10 is moved to its maximum open position in which the front flat free end surface 30 at each projection 28 engages the upper end 44 of a complementary recess 42, and back surface 32 of each finger 24 engages a rear edge 46 of a complementary blind end surface 38. If additional force is applied to cover portion 16 to open it further, back surface 32 of each finger 24 pivots about complementary rear edge 46 causing rounded projection 28 to be forced out of recess 42 and notch 34 for separating cover portion 10 from bottom portion 12 as seen in FIG. 6. The pivot portions of rear edge 46 in alignment with the back surfaces 32 of finger 24 are supported or buttressed by reinforcing ribs 48.

While a presently preferred embodiment of the invention has been shown and described with particularity, it will be appreciated that various changes and modifications may suggest themselves to one having ordinary skill in the art upon being apprized of the present invention. It is intended to encompass all such changes and modifications as fall within the scope and spirit of the appended claims.

What is claimed is:

1. A releasable hinge for cover and bottom portions of a container or the like having cover and bottom rear walls lying substantially in one plane when the container is closed, said cover and bottom rear walls further having edge surfaces facing one another in said closed position, said hinge comprising:

a pair of spaced apart laterally flexible spring fingers, each lying substantially in a plane transverse to said one plane and having a free end projecting from one of said cover and bottom rear walls toward the other of said cover and bottom rear walls, each free end of said fingers further extends beyond its complementary edge surface and has a flat front surface in alignment with the front side of said cover rear wall, and a back surface extending rearwardly of the back side of said cover rear wall and merging with said front surface at the free end of said finger, each of said fingers further having a laterally extending rounded projection on the outer side of said free end thereof; and a blind notch on said other of said cover and bottom rear walls for receiving said fingers, said notch having side surfaces arranged and spaced to laterally flex said spring fingers together as they are introduced into said notch, said side surfaces further having opposed recesses at the blind end of said notch for receiving said projections whereby said rear walls of said container are hinged together until said container is opened beyond a maximum open position causing said back surfaces of said fingers to engage and pivot about said blind end of said notch forcing said projections out of said recesses for unhinging said rear walls.

2. A releasable hinge according to claim 1 wherein each of said back surfaces is transverse to said one plane.

3. A releasable hinge according to claim 2 wherein said blind end of said notch has an edge thereof rearward of said recesses forming a pivot for said back surfaces.

4. A releasable hinge for cover and bottom portions of a container or the like having cover and bottom rear walls lying substantially in one plane when the container is closed, said cover and bottom rear walls further having end surfaces facing one another in said closed position, said hinge comprising:

a pair of spaced apart laterally flexible spring fingers, each lying substantially in a plane transverse to said one plane and having a free end projecting from one of said cover and bottom rear walls toward the other of said cover and bottom rear walls, each free end of said fingers further extends beyond its complementary edge surface and has a flat front surface in alignment with the front side of said cover rear wall, and a back surface extending rearwardly of the back side of cover rear wall and merging with said front surface at the free end of said finger, each of said fingers further having a laterally extending projection on the outer side of said free end thereof, said projection having an arcuate surface terminating in a flat edge lying in the same plane as said flat front surface to form an arcuate edge; and a blind notch on said other of said cover and bottom rear walls for receiving said fingers, said notch having side surfaces arranged and spaced to laterally flex said spring fingers together as they are introduced into said notch, said side surfaces further having opposed recesses at the blind end of said notch for receiving said projections for hinging said rear walls of said container together, each of said recesses further having an end wall engageable by one of said flat edges of said projections when said cover portion of said container is opened for holding said cover portion in a maximum open position, said container when accidently opened beyond its maximum open position causing said back surfaces of said fingers to engage and pivot about said blind ends of said notches forcing said arcuate edges of said projections along respective edges of said end walls for camming said projections out of said recesses for unhinging said rear walls.

* * * * *